US012601148B2

(12) United States Patent
Kennedy

(10) Patent No.: US 12,601,148 B2
(45) Date of Patent: Apr. 14, 2026

(54) ELECTRIC WORK VEHICLE WITH POWER CONSERVING WORK COMPONENT SUBSYSTEM PRECONDITIONING

(71) Applicant: Deere & Company, Moline, IL (US)

(72) Inventor: Thomas L. Kennedy, Bettendorf, IA (US)

(73) Assignee: DEERE & COMPANY, Moline, IL (US)

( * ) Notice: Subject to any disclaimer, the term of this patent is extended or adjusted under 35 U.S.C. 154(b) by 207 days.

(21) Appl. No.: 18/488,678

(22) Filed: Oct. 17, 2023

(65) Prior Publication Data

US 2025/0122695 A1 Apr. 17, 2025

(51) Int. Cl.
*E02F 9/20* (2006.01)

(52) U.S. Cl.
CPC ..... *E02F 9/207* (2013.01); *E02F 9/2095* (2013.01)

(58) Field of Classification Search
CPC ..... E02F 9/207; E02F 9/2095
See application file for complete search history.

(56) References Cited

U.S. PATENT DOCUMENTS

| | | | | |
|---|---|---|---|---|
| 8,773,066 | B2 | 7/2014 | Kelty | |
| 11,127,993 | B2 | 9/2021 | King | |
| 11,654,794 | B1 * | 5/2023 | Khattar | H01M 10/625 244/6 |
| 2022/0271363 | A1 | 8/2022 | Burkell et al. | |
| 2023/0001824 | A1 * | 1/2023 | Shaotran | H01M 10/633 |
| 2023/0137357 | A1 * | 5/2023 | Chopra | H02J 7/007188 |

FOREIGN PATENT DOCUMENTS

| | | | |
|---|---|---|---|
| CN | 114976305 | A | 8/2022 |
| CN | 110072719 | A | 4/2023 |
| EP | 3519215 | A1 | 7/2020 |
| EP | 4046859 | A1 | 8/2022 |
| JP | 2022127599 | A | 8/2022 |
| WO | WO2018064054 | A1 | 4/2018 |

* cited by examiner

*Primary Examiner* — Edwin A Young
(74) *Attorney, Agent, or Firm* — KLINTWORTH & ROZENBLAT LLP

(57) ABSTRACT

An electric work vehicle includes an electric power source; an electric motor; a work component powered by the electric power source during the power-consuming state; a work component subsystem operating the work component and powered by the electric power source; a thermal management system including a thermal device for affecting the temperature range of the work component subsystem; and a controller. The controller receives a predictive condition value indicative of an environmental condition of the work location at the work time, the predictive condition value being received preceding the work time; based on the predictive condition value, sets an operational state of the thermal device; and operates the thermal device at the operational state set according to the predictive condition value to precondition the work component subsystem prior to work time to reduce power demands on the electric power source during the power-consuming state.

20 Claims, 3 Drawing Sheets

ELECTRIC WORK VEHICLE WITH POWER CONSERVING WORK COMPONENT SUBSYSTEM PRECONDITIONING

CROSS-REFERENCE TO RELATED APPLICATION(S)

Not applicable.

STATEMENT OF FEDERALLY SPONSORED RESEARCH OR DEVELOPMENT

Not applicable.

FIELD OF THE DISCLOSURE

This disclosure generally relates to electric work vehicles, and more specifically to conserving battery power during work implement operation.

BACKGROUND OF THE DISCLOSURE

Heavy-duty work vehicles, such as those used in the agricultural, construction, forestry, and mining industries, may utilize an entirely electric power source for tractive power to turn the ground-engaging wheels or tracks and to power various subsystems associated with work implements that perform work operations. Some of the work implement subsystems perform optimally within certain thermal conditions. To ensure that the work implement performs well under the conditions present at a work site, it may be beneficial to warm or cool the implement subsystem so that it is within optimal thermal conditions at the time the work is to be performed at a work site. Such operation requires that additional energy be input to the implement subsystem. In an electric work vehicle, this energy would be from the electric power source and may impact the power available for vehicle traction or work operations.

SUMMARY OF THE DISCLOSURE

In one example, an electric work vehicle includes an electric power source operable in a power-charging state and a power-consuming state; an electric motor powered by the electric power source; a work component powered by the electric power source during the power-consuming state to perform a work operation at a work location at a work time; a work component subsystem operating the work component and powered by the electric power source, the work component subsystem optimally operable within a temperature range; a thermal management system including a thermal device for affecting the temperature range of the work component subsystem; and a controller, including processor and memory architecture. The controller executes control logic to: receive a predictive condition value indicative of an environmental condition of the work location at the work time, the predictive condition value being received by the controller at an evaluation time preceding the work time; based on the predictive condition value, set an operational state of the thermal device of the thermal management system; and operate the thermal device at the operational state set according to the predictive condition value to precondition the work component subsystem prior to the work time to reduce power demands on the electric power source during the power-consuming state.

In the electric work vehicle, the controller is configured to operate the thermal device to precondition the work component subsystem during the power charging state of the electric power source.

In an example of the electric work vehicle, the predictive condition value is extracted from a weather forecast feed received by the controller; the weather forecast includes an anticipated precipitation value as the predictive condition value received by the controller; and the controller compares the anticipated precipitation value to a threshold precipitation value to determine whether to precondition the work component subsystem.

In an example of the electric work vehicle, the predictive condition value is extracted from a weather forecast feed received by the controller; the weather forecast includes an ambient temperature value as the predictive condition value received by the controller; and the controller processes the ambient temperature value to set the operational state of the thermal device and determine a period of time to operate the thermal device and precondition the work component subsystem during the power-charging state of the electric power source.

In an example of the electric work vehicle, the work component subsystem includes a working fluid utilized by the work component subsystem to operate the work component; and the temperature range applies to the working fluid.

In an example of the electric work vehicle, the work component is a traction drive including a gear reduction assembly that provides rotational torque to ground-engaging wheels or tracks of the electric work vehicle.

In an example of the electric work vehicle, the work component is a work implement including an implement actuator, the work component subsystem being operable to effect movement of the work implement by the implement actuator.

In an example of the electric work vehicle, the work component subsystem includes a pump for pressurizing the working fluid; and the implement actuator includes a piston-cylinder driven by the pressurized working fluid of the work component subsystem.

In an example of the electric work vehicle, the thermal device includes a heating device, a cooling device, or both; the thermal device includes an off state in which the thermal device is idle or provides a passive thermal effect on the temperature range of the work component subsystem; and the thermal device includes an on state in which the thermal device is energized to provide an active thermal effect on the temperature range of the work component subsystem.

In an example of the electric work vehicle, the controller is configured to execute the control logic to receive a state input for the thermal device indicating whether the thermal device is in the off state or the on state, and to change the state of the thermal device from the off state to the on state when the predictive condition value indicates to precondition the work component subsystem only during the power-charging state of the electric power source.

In an example of the electric work vehicle, the controller is configured to execute the control logic to receive a charge state input for the electric power source indicating whether the electric power source is in the power-charging state or the power-consuming state, and to operate the thermal device at the operational state set according to the predictive condition value to precondition the work component subsystem only during the power-charging state of the electric power source.

In a further example, an electric work vehicle includes an electric power source operable in a power-charging state and a power-consuming state; an electric motor powered by the electric power source; a work component powered by the electric power source during the power-consuming state to perform a work operation at a work location at a work time; a work component subsystem operating the work component and powered by the electric power source, the work component subsystem includes a working fluid to operate the work component and which is optimally operable within a temperature range; a thermal management system including a thermal device for affecting the temperature range of the work component subsystem; and a controller, including processor and memory architecture. The controller executes control logic to: receive a predictive condition value indicative of an environmental condition of the work location at the work time, the predictive condition value being received by the controller at an evaluation time preceding the work time; based on the predictive condition value, set an operational state of the thermal device of the thermal management system; and operate the thermal device at the operational state set according to the predictive condition value to precondition the work component subsystem prior to the work time to reduce power demands on the electric power source during the power-consuming state.

In an example of the electric work vehicle, the controller is configured to operate the thermal device to precondition the work component subsystem during the power charging state of the electric power source.

In an example of the electric work vehicle, the predictive condition value is extracted from a weather forecast feed received by the controller; the weather forecast includes an anticipated precipitation value as the predictive condition value received by the controller; and the controller compares the anticipated precipitation value to a threshold precipitation value to determine whether to precondition the work component subsystem.

In an example of the electric work vehicle, the predictive condition value is extracted from a weather forecast feed received by the controller; the weather forecast includes an ambient temperature value as the predictive condition value received by the controller; and the controller processes the ambient temperature value to set the operational state of the thermal device and determine a period of time to operate the thermal device and precondition the work component subsystem during the power-charging state of the electric power source.

In an example of the electric work vehicle, the work component is a traction drive including a gear reduction assembly that provides rotational torque to ground-engaging wheels or tracks of the electric work vehicle.

In an example of the electric work vehicle, the work component is a work implement including an implement actuator, the work component subsystem being operable to effect movement of the work implement by the implement actuator; the work component subsystem includes a pump for pressurizing the working fluid; and the implement actuator includes a piston-cylinder driven by the pressurized working fluid of the work component subsystem.

In an example of the electric work vehicle, the thermal device includes a heating device, a cooling device, or both; wherein the thermal device includes an off state in which the thermal device is idle or provides a passive thermal effect on the temperature range of the implement subsystem; and wherein the thermal device includes an on state in which the thermal device is energized to provide an active thermal effect on the temperature range of the work component subsystem.

In an example of the electric work vehicle, the controller is configured to execute the control logic to receive a state input for the thermal device indicating whether the thermal device is in the off state or the on state, and to change the state of the thermal device from the off state to the on state when the predictive condition value indicates to precondition the work component subsystem only during the power-charging state of the electric power source.

In an example of the electric work vehicle, the controller is configured to execute the control logic to receive a charge state input for the electric power source indicating whether the electric power source is in the power-charging state or the power-consuming state, and to operate the thermal device at the operational state set according to the predictive condition value to precondition the work component subsystem only during the power-charging state of the electric power source.

The details of one or more embodiments are set forth in the accompanying drawings and the description below. Other features and advantages will become apparent from the description, the drawings, and the claims.

DETAILED DESCRIPTION

Figure 1:
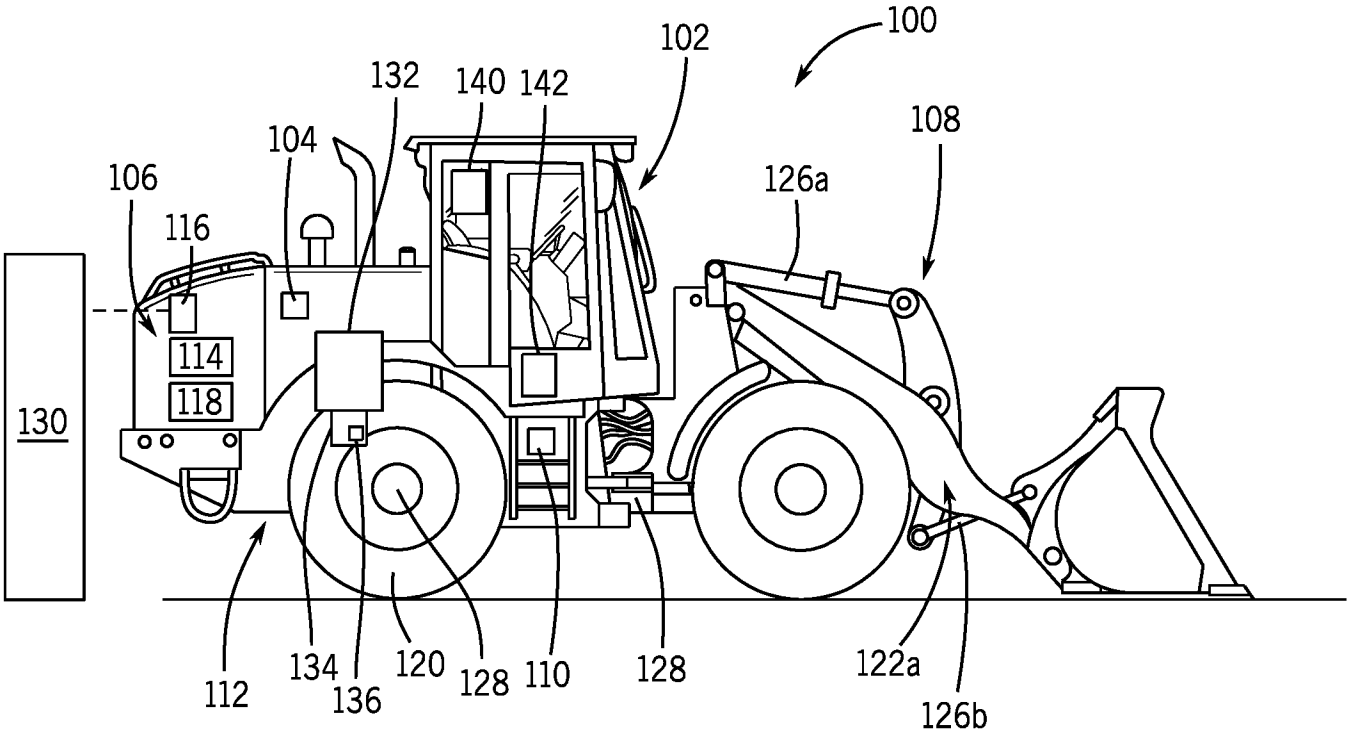
FIG. 1 is an example electric work vehicle in the form of a loader in which a work component subsystem preconditioning system may be utilized.

The following detailed description describes one or more example embodiments of a disclosed electric work vehicle preconditioning control system and method, as shown in the accompanying figures of the drawings described briefly above. Various modifications to the example embodiments may be contemplated by one of skill in the art. Discussion herein focuses on the electric work vehicle being an agricultural tractor, but the electric work vehicle be other work vehicle platforms in the agriculture industry as well as in industries other than agricultural, such as construction, forestry, mining, etc.

Overview

Conventional work vehicles typically include a fuel-consuming power source, such as an internal combustion engine (e.g., a diesel or gas engine) to power vehicle traction and work implements. Such work vehicles typically include various hydraulic and electro-hydraulic subsystems that facilitate vehicle traction and operation of the work implements. These subsystems typically operate optimally when the hydraulic fluid is at or within a certain temperature or temperature range. For vehicle drives or work implements to perform optimally, the subsystems may be preconditioned in advance of the need to perform vehicle traction or work operation. Such preconditioning typically occurs during an initial warm-up period in which the engine is operated for a period of time immediately prior to undertaking a work session. Operation of the engine powers various subsystems of the work vehicle, including pumps and various components to circulate hydraulic fluid through the subsystems themselves, and various thermal management devices, such as electric heaters or fans, pumps and other components of various air or liquid cooling circuits.

While efficient fuel consumption may be a factor in engine and vehicle design generally, energy conservation is generally not a primary concern in such conventional work vehicles. This aspect is not the case with work vehicles having electric power sources instead of fuel-consuming power sources, such as internal combustion engines. In electric work vehicles, the costs associated with electric storage devices and their inherent limitations in power capacity and charging time demand a much more stringent management of energy consumption in order to optimize available power for vehicle traction and work operations.

This disclosure provides for an electric work vehicle in which preconditioning of a work component subsystem is controlled to preserve electric power. The electric work vehicle has an electric power source (e.g., one or more battery packs, generally "battery") of various technologies (e.g., lead-acid, lithium, lithium ion, lithium polymer, lithium sulfur, lithium iron phosphate, lithium cobalt oxide, nickel-metal hydride, nickel-cadmium, solid-state, or other known or emerging battery technologies.) The electric power source is operable in a power-charging state and a power-consuming state. As described below, the power-consuming state may include a power-consuming substate in which the work vehicle subsystem is using the battery for power during a work function and a lesser power-consuming substate in which the work vehicle subsystem is not using the battery but the battery is not in the power-charging state (e.g., an idle state). The electric work vehicle also has an electric motor powered by the electric power source.

When the electric power source is in a power-charging state, the electric power source is effectively not being used. The preconditioning that occurs under this condition is provided by the electric power grid that is used to power/recharge the electric power source. Accordingly, the preconditioning referred to herein is effectively provided by the electric power grid, rather than the electric power source of the electric vehicle.

The electric work vehicle has a work component powered by the electric power source during the power-consuming state to perform a work operation at a work location at a work time. A work component subsystem operates the work component and is powered by the electric power source. The work component subsystem optimally operates within a given temperature range required for the operation of the work component subsystem. As used herein, the term "work component" will be understood to define a component or assembly that is part of a traction drive or work implement. The term "work component subsystem" will be understood to define a system or assembly that facilitates operation of a work component (e.g., a traction drive or work implement) in which operation of the work component subsystem is optimal within a prescribed temperature range. These terms exclude conventional systems for managing the conditions and performance of the electric power source or battery itself. The electric work vehicle also has a thermal management system that includes a thermal device for affecting the temperature range of the work component subsystem.

The electronic work vehicle has a control system including a controller with processor and memory architecture. The controller executes control logic to receive a predictive condition value indicative of an environmental condition of the work location at the work time. The predictive condition value is received by the controller at an evaluation time preceding the work time. Based on the predictive condition value, the controller sets an operational state of the thermal device of the thermal management system and operates the thermal device at the set operational state to precondition the work component subsystem during the power-charging state of the electric power source prior to the work time to reduce power demands on the electric power source during the power-consuming state.

In some cases, the work component subsystem includes a hydraulic fluid utilized by the work component subsystem to operate the work component. In such cases, the temperature range applies to the hydraulic fluid. As an example, extreme temperature may impact the impact responsiveness and efficiency of hydraulic systems. The work component may be any number of components or assemblies carried by the electric work vehicle that affect vehicle traction or work operation. For example, the work component may be a hydraulic traction drive, such as a wheel end or "final" drive, that includes a gear reduction assembly providing rotational torque to ground-engaging wheels or tracks of the electric work vehicle. As another example, the work component may be a work implement including one or more hydraulic actuators, such as piston-cylinder arrangements. The work component subsystem may include a pump and hydraulic circuit for carrying pressurized hydraulic fluid to the hydraulic actuators. The work implements may be any of various known work implements, such as various boom and bucket assemblies for loaders and backhoes, blades, plows, rakes, grapples, and numerous specialized implements for specific agricultural machines.

The predictive condition value may be a sensed or derived value from any of various sensor devices or data sources onboard or remote to the electric work vehicle. In some cases, the predictive condition value is extracted from a weather or environmental forecast feed received by the controller. The weather or environmental forecast may include various information indicated by the ambient environment at a given work site. Such information may include air temperature, humidity, atmospheric pressure, dew point, wind speed, sunrise/sunset times, precipitation (e.g., rain, sleet, snow, etc.) and various other information pertaining to the environment at the work site. In some cases, for example, the weather or environmental forecast may provide an anticipated precipitation value as the predictive condition value. When received by the controller, the anticipated precipitation value may be compared to a threshold precipitation value to determine whether to precondition the work component subsystem. In other examples, the weather forecast may include an ambient temperature value as the predictive condition value received by the controller, which processes the ambient temperature value to set the operational state of the thermal device and determine a period of time to operate the thermal device and precondition the work component subsystem during the power-charging state of the electric power source. Various other sensors, feeds, and predictive values may be obtained and processed by the controller in making the preconditioning determination.

A thermal management system may include any suitable heating and cooling devices (e.g., fans, pumps, valves, heat exchangers, and so on). These devices may utilize a gaseous (e.g., air) or liquid medium for effecting the cooling or heating of the work component subsystem. The thermal device may be turned off or operated in one or more on states. In the off state, the thermal device may be idle or provide a passive thermal effect on the temperature range of the work component subsystem. In the one or more on states, the thermal device may be energized to provide an active thermal effect on the temperature range of the work component subsystem. The controller may be configured to execute the control logic to receive a state input for the thermal device indicating whether the thermal device is in the off state or an on state, and to change the state of the thermal device from the off state to the on state when the predictive condition value indicates to precondition the work component subsystem only during the power-charging state of the electric power source. In various embodiments, the controller may be configured to execute the control logic to receive a charge state input for the electric power source indicating whether the electric power source is in the power-charging state or the power-consuming state. In such cases, the controller may operate the thermal device at the operational state set according to the predictive condition value to precondition the work component subsystem only during the power-charging state of the electric power source.

These and other aspects of the disclosed electric work vehicle will be better understood with regard to an example work vehicle, which will now be described.

Example Electric Work Vehicle with Power Conserving Work Component Subsystem Preconditioning An exemplary embodiment of an electric work vehicle 100 subject to power conservation via a preconditioning function is shown in FIG. 1. In the depicted example, the work vehicle 100 is in the form of a loader may include or otherwise implement a preconditioning control system 102 that functions to selectively precondition or to forego preconditioning of one or more subsystems of the work vehicle 100 between work activities (e.g., during the evening, or after a day or session of operation and before a potential day or session of operation) based on various parameters, including a weather forecast.

The work vehicle 100 may be considered to include or otherwise interact with a controller 104, a powertrain 106, one or more implement arrangements 108, and one or more sensors 110 supported on the chassis 112 of the work vehicle 100. In FIG. 1, the work vehicle 100 as a loader is provided as an example work vehicle or machine. It will be understood, however, that other configurations may be possible, including configurations with work vehicle 100 as other machines for lifting and moving various materials in the agricultural, construction, and/or forestry industries. Particular examples include a tractor, backhoe, harvester, mower, snowblower, and the like.

Generally, the powertrain 106 includes one or more electric motors 114 and one or more additional electric power sources 116 (e.g., one or more batteries, generally "battery"). In one example, the battery 116 may operate in various states, including a power-charging state in which the battery 116 is supplied and stores energy, e.g., via a grid or utility connection 130, or a power-consuming state in which the battery 116 provides power (e.g., to operate one or more work component, such as aspects of the powertrain 106 and/or implement arrangement 108, described below). As described below, the battery 116 may itself be considered a work component subsystem that operates in optimum temperature range, such that preconditioning may improve overall performance.

The powertrain 106 further includes a transmission 118 that transfers power from the power sources 114, 116 to a suitable driveline coupled to one or more driven wheels 120 to enable propulsion of the work vehicle 100. The transmission 118 may also supply power to drive other components of the work vehicle 100, including the implement arrangement 108, described below. The transmission 118 may include various gears, shafts, clutches, and other power transfer elements that may be operated in a variety of ranges representing selected output speeds and/or torques.

In one example, as noted above, the transmission 118 may transfer power directly to the two driven wheels 120 and/or via traction drives 128 at or near the wheels 120. In some examples, the traction drives 128 may be hydraulic traction drives in which the battery 116 powers a hydraulic pump that pressurizes hydraulic fluid, which in turn generates rotational torque via various gear reductions, thereby providing the necessary power for traction to move the tractor. The traction drives 128 may be considered a work component subsystem to facilitate operation of the work vehicle 100. Generally, the traction drives 128 may include various components that may have an optimum operating temperature range, such that implementation of the preconditioning control system 102 may be beneficial.

The implement arrangement 108 depicted in FIG. 1 is merely an example, and tractors and other work vehicle may use a diverse range of implement and hydraulic systems to perform various functions, including blades, plows, rakes, snow blowers, grapples, mowers, and numerous other specialized tools tailored to specific work vehicles. As in the arrangement 108 of FIG. 1, such implements may be operated hydraulically.

As introduced above, the work vehicle 100 further includes the implement arrangement 108 that performs one or more work tasks, including digging tasks. In one example, the implement arrangement 108 includes a boom 122*a* and a bucket 124*a*. As shown, the boom 122*a* has a first end coupled to the chassis 112 and a distal end on which the bucket 124*a* is mounted. Various linkages, cross-rods, mounts, pins, and the like may be provided. The bucket 124*a* is generally configured to receive a load of material. The implement arrangement 108 further includes one or more actuators 126*a*, 126*b* that are configured to reposition the boom 122*a* and/or bucket 124*a*. In one example, the actuators 126*a*, 126*b* are hydraulic cylinders in which a first actuator (or set of actuators) 126*a* extends between the chassis 112 and the boom 122*a* to reposition the boom 122*a* and a second actuator (or set of actuators) 126*b* extends between the boom 122*a* and the bucket 124*a* to reposition the bucket 124*a* relative to the boom 122*a*. The implement arrangement 108 may be considered a work component subsystem to facilitate operation of the work vehicle 100. Generally, the implement arrangement 108 may include various components that may have an optimum operating temperature range such that implementation of the preconditioning control system 102 may be beneficial.

As also introduced above, the work vehicle 100 may include a hydraulic system 132 that provides pressurized fluid to operate various components, including the implement arrangement 108 and traction drives 128. The hydraulic system 132 may include one or more pumps and accumulators (as well as various control valves and conduits) that may be driven by the power sources 114, 116, directly or via the transmission 118. The hydraulic system 132 may be considered a work component subsystem to facilitate operation of the work vehicle 100. Generally, the hydraulic system 132 may include various components and working fluids that may have optimum operating temperature ranges.

In some examples, the work vehicle 100 may include a cabin HVAC (heating/ventilation/air conditioning) system or arrangement 140 that functions to direct heating, cooling, or ventilating air flow to an operator in the cabin. The cabin HVAC arrangement 140 may include various heating elements, cooling elements, fans, and the like to improve the comfort of the operator. In some contexts, the cabin HVAC arrangement 140 may be considered a work component subsystem that facilitates the overall operation of the work vehicle 100, and the cabin HVAC arrangement may have an optimum temperature range such that implementation of the preconditioning control system 102 may be beneficial.

In some examples, the work vehicle 100 may include an airflow arrangement 142. The airflow arrangement 142 may include a fan that generates a flow of air and a number of airflow structures (e.g., plenums, tubes, lines, etc.) that receive the air blowing from the fan. Such an arrangement 142 may facilitate the manipulation of material within the work vehicle 100. In some contexts, the airflow arrangement 142 may be considered a work component subsystem that facilitates the overall operation of the work vehicle 100. The airflow arrangement 142 may have an optimum temperature range such that implementation of the preconditioning control system 102 may be beneficial.

The work vehicle 100 may further include a thermal management system 134 that includes one or more thermal devices 136 to heat and/or cool various aspects of the work vehicle 100, including aspects of the hydraulic system 132 and/or the implement arrangement 108, as well other subsystem components of the work vehicle 100. In addition to one or more thermal devices 136, the thermal management system 134 may include heating elements, cooling elements, fans, fluid and/or air system, and the like. The thermal management system 134 may include dedicated thermal management systems or subsystem that function to address a particular work component subsystem (e.g., the battery 116, implement arrangement 108, the cabin HVAC arrangement 140, and/or airflow arrangement 142) or may be part of an integrated system.

Generally, the controller 104 implements operation of the preconditioning control system 102, powertrain 106, and other aspects of the work vehicle 100, including any of the functions described herein. The controller 104 may be configured as computing devices with associated processor devices and memory architectures, as hydraulic, electrical or electro-hydraulic controllers, or otherwise. As such, the controller 104 may be configured to execute various computational and control functionality with respect to the work vehicle 100. The controller 104 may be in electronic, hydraulic, or other communication with various other systems or devices of the work vehicle 100, including via a CAN bus (not shown). For example, the controller 104 may be in electronic or hydraulic communication with various actuators, sensors, and other devices and systems within (or outside of) the work vehicle 100, some of which are discussed in greater detail below. An example location for the controller 104 is depicted in FIG. 1. It will be understood, however, that other locations are possible including other locations on the work vehicle 100, or various remote locations.

In some embodiments, the controller 104 may be configured to receive input commands and to interface with an operator via a human-machine interface or operator interface (not shown), including typical steering, acceleration, velocity, transmission, and wheel braking controls, as well as other suitable controls. The human-machine interface may be configured in a variety of ways and may include one or more joysticks, various switches or levers, one or more buttons, a touchscreen interface that may be overlaid on a display, a keyboard, a speaker, a microphone associated with a speech recognition system, or various other human-machine interface devices. The controller 104 may also receive inputs from one or more sensors 110 associated with the various system and components of the work vehicle 100 and environment to implement the preconditioning control system 102.

As noted above, the work vehicle 100 may include one or more sensors (generally represented by sensor 110) in communication to provide various types of feedback and data with the controller 104 in order to implement the functions described herein. In certain applications, sensors 110 may be provided to observe various conditions associated with the work vehicle 100, including the environment of the work vehicle 100. In one example, the sensors 110 may provide information associated with the ambient temperature and/or precipitation associated with the work vehicle 100 and/or intended work site. Generally, the sensors 110 are onboard the work vehicle 100. However, as discussed below, sensors 110 (and/or other sources of information) may be located offboard the work vehicle 100 (e.g., received by the work vehicle via one or more communications devices). Such information sources may include a weather forecast for the present, the following work session (e.g., the next day), and/or the time in between the present and the following work session (e.g., the time period between the end of the work session the subsequent work session) at the work site. The sensors 110 may also include mechanisms for determining the state of the battery 116 (e.g., power-saving or power-consuming) and/or the thermal device 136 (e.g., on state or off state). As described below, the preconditioning control system 102 may consider this information in implementing the preconditioning functions.

The preconditioning control system 102 may be considered to include a controller 104, the thermal device 136, and optionally, one or more work component subsystems discussed above. As described in greater detail below, the preconditioning control system 102 operates to evaluate various parameters in context to identify one or more predictive condition values indicative of one or more environmental conditions of the work location at a future work time; and based on the predictive condition values, the preconditioning control system 102 may set the operational state of the thermal management system 134 to precondition one or more of the work component subsystems.

Figure 2:
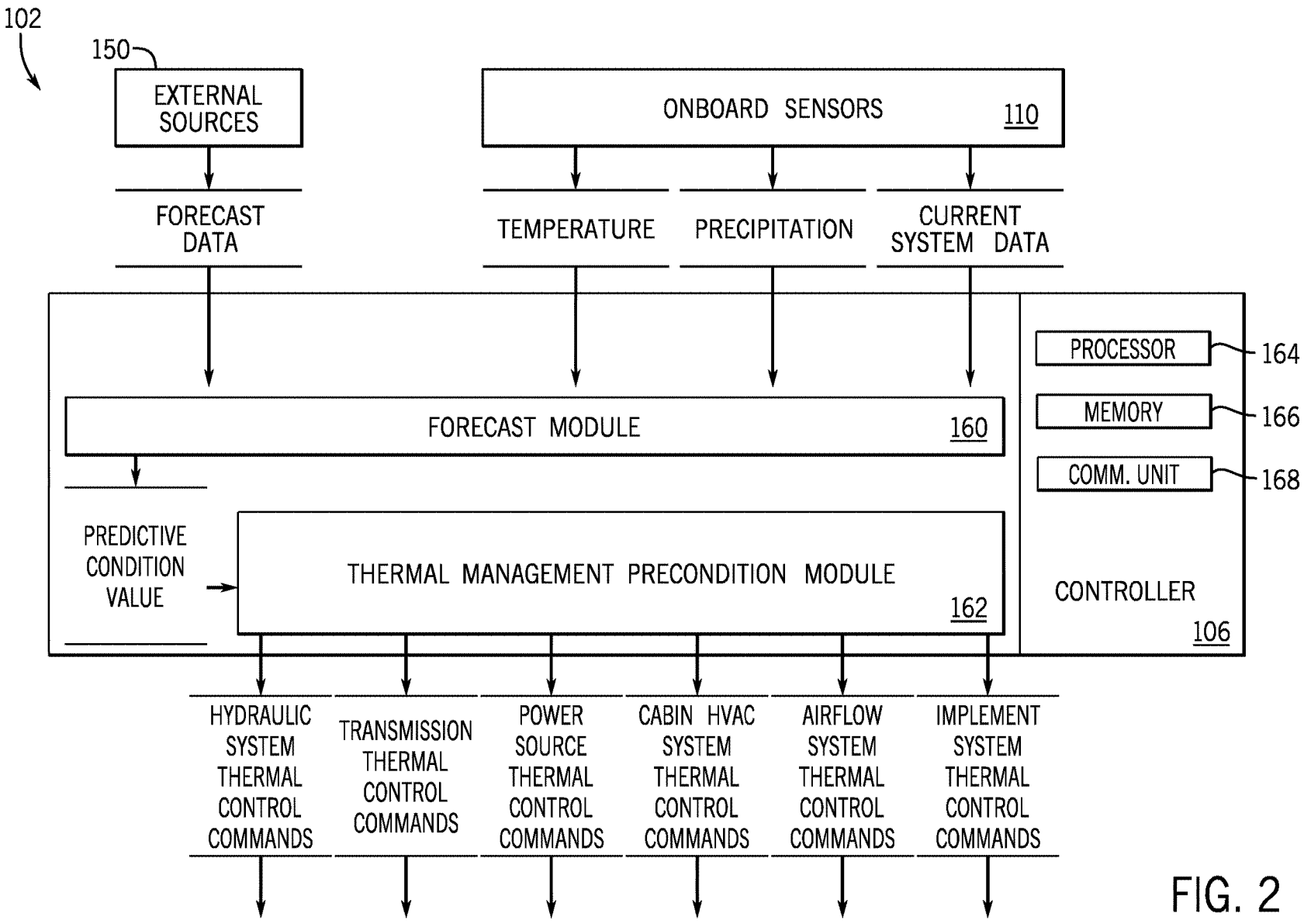
FIG. 2 is a dataflow diagram of the work component subsystem preconditioning control system in accordance with an example embodiment.

Referring now also to FIG. 2, a dataflow diagram illustrates an embodiment of the preconditioning control system 102 implemented by the onboard sensors 110, controller 104, and external data sources 150 to execute the preconditioning functions to generate appropriate commands for implementation via the thermal management system 134 (FIG. 1) to precondition one or more work component subsystems (e.g., the hydraulic system 132, transmission 118, battery 116, cabin HVAC arrangement 140, airflow arrangement 142, and/or implement arrangement 108). Generally, the controller 104 may be considered a vehicle controller or a dedicated controller, such as a thermal management system controller or controllers.

With respect to the preconditioning control system 102 of FIG. 2, the controller 104 may be organized as one or more functional units or modules 160, 162 (e.g., software, hardware, or combinations thereof). As can be appreciated, the modules 160, 162 shown in FIG. 2 may be combined and/or further partitioned to carry out similar functions to those described herein. As an example, each of the modules 160, 162 may be implemented with processing architecture such as a processor 164 and memory 166, as well as one or more suitable communication interfaces or units 168. For example, the controller 104 may implement the modules 160, 162 with the processor 164 based on programs or instructions stored in memory 166. Generally, the communication unit 168 may couple various system components including the memory 166 to the processor 164, as well as components within and outside of the work vehicle 100. In one example, the communication unit 168 functions to enable wireless communication, including directly (e.g., via Bluetooth®, radio frequency signals, or the like) or over a network. Thus, the communication unit 168 may include a Bluetooth® transceiver, a radio transceiver, a cellular transceiver, an LTE transceiver, and/or a Wi-Fi transceiver. For example, such communications may utilize one or more of various communication techniques or mechanisms, including radio frequency, Wi-Fi, cellular, telematics, and/or any other suitable platforms.

In some examples, the consideration and implementation of the preconditioning function by the controller 104 are continuous, e.g., constantly active. In other examples, the activation of the precondition function may be selective, e.g., enabled or disabled based on input from the operator or other considerations. In any event, the precondition function may be enabled and implemented by the preconditioning control system 102, as described below.

As shown, generally, the controller 104, particularly a forecast module 160, may receive input data in a number of forms and/or from a number of sources. In FIG. 2, the forecast module 160 is depicted as receiving input data from onboard sensors 110 and external data sources 150, although such input data may also come in from other systems or controllers, either internal or external to the work vehicle 100. Generally, the input data considered by the forecast module 160 represents any data sufficient to evaluate the conditions that may potentially impact the operation of one or more of the work component subsystems of the work vehicle 100 during a subsequent work session. As an example, such information may be considered during an evaluation period after a work session (e.g., day "n") prior to a subsequent potential work session (e.g., day "n+1").

As shown, the onboard sensors 110 may provide the forecast module 160 with information regarding the current temperature, precipitation, and current system data about various components and/or systems (e.g., such as fluid or component temperatures or pressures). The external data sources 150 may provide forecast data with information associated with the current and/or future temperatures and/or precipitation at the work site.

Generally, for forecast module 160 considers the information from the onboard sensors 110 and the external data sources 150 and extracts and/or derives one or more predictive condition values representing anticipated future conditions parameters associated with the environment of the work vehicle 100 and/or work sites. In one example, the forecast module 160 may also receive the status of the battery 116, e.g., to indicate if the battery 116 is in the power-charging state or in the power-consuming state. If the battery 116 is in the power-consuming state, the forecast module 160 may terminate any preconditioning function or may terminate any modification of the preconditioning function based on the predictive condition values. If the forecast module 160 determines that the battery 116 is in the power-charging state, the forecast module 160 provides one or more predictive condition values to the thermal management precondition module 162. In some examples, the forecast module 160 (and the system 102 overall) may generate and/or consider the predictive condition values and operate to precondition the work component subsystem prior to the work time, as described below, regardless of the state of the battery 116.

The thermal management precondition module 162 considers the predictive condition values, particularly in the context of the functions of the various work component subsystems. For example, the thermal management precondition module 162 determines if the predictive condition values indicate that the work component subsystems will be operating in during the next work session. Such a determination may depend on the nature of the respective work component subsystems. To achieve this, the thermal management precondition module 162 may include or otherwise access a model that evaluates the predictive condition values in view of both the function of one or more of the work component subsystems and the optimum temperature ranges of the component subsystems to achieve (or forego) the optimum range during the evaluation period for the time of operation. Such a model may include thermodynamic models about the relationships temperatures and/or precipitation, the thermal devices 136, and/or the component subsystems, as well as other aspects of the work vehicle 100 and/or the environment.

Additional details are provided below, but generally as noted above, the thermal management precondition module 162 does not modify the preconditioning function unless the battery 116 is in the power-charging state, although, as noted, in some examples the thermal management precondition module 162 may modify the preconditioning function regardless of the state of the battery 116. Further the thermal management precondition module 162 may determine that operation the next day is unlikely considering the function of the work vehicle 100 or the work vehicle component subsystem (e.g., no snow for a snow plow, or excessive rain for an agricultural vehicle). Upon receiving the predictive condition value, the thermal management precondition module 162 may determine a mechanism to efficiently precondition one or more of the work component subsystems in order to reduce the demands on the battery 116 during a subsequent power-consuming state. In other words, the thermal management precondition module 162 may generate commands at a specified time to activate the thermal device 136 such that the respective component subsystem achieves the optimum temperature at the time of operation. This enables preconditioning when the battery 116 is in the power charging state (e.g., connected to the grid 130) rather than the power consuming state (e.g., at the work site prior to operation). In some instances, the thermal management precondition module 162 may consider the predictive condition values and use passive measures when the battery 116 is in the power charging state in order to facilitate preconditioning. For example, if 1) the respective work component subsystem is relatively warm after operation for the day, 2) temperatures are expected to be relatively low, and 3) and operation is expected to occur the next work session, the thermal management precondition module 162 may disable a cooling function of the work component subsystem that would otherwise occur such that the subsequent warming during preconditioning may be reduced or avoided. As noted above, the thermal management precondition module 162 may modify the preconditioning function regardless of the state of the battery 116 and/or precondition in a different manner. In other words, in one example, the thermal management precondition module 162 operates to precondition the work component subsystem only when the battery 116 is in the power-charging state; and in a further example, thermal management precondition module 162 may operate to precondition the work component subsystem even when the battery 116 is not in the power-charging state, particularly when the battery 116 is in the less power-consuming or idle state in which the work component subsystem is not placing a burden on the battery 116 but also is not in the power-charging state. In a further example, the thermal management precondition module 162 may operate to precondition the work component subsystem prior to the work time, even when the battery 116 is not in the power-charging state, but to a lesser or modified extent than work component subsystem would otherwise be preconditioned if the battery 116 was in the power-charging state. In such a scenario, the thresholds at which the work component subsystem is preconditioned may be more strict or conservative so as not to consume as much of the power from the battery 116 as would otherwise occur.

Reference is made of the following example: The work vehicle 100 may a loader, such as represented in FIG. 1, and the loader intends to maneuver and dig with various work component subsystems (e.g. the implement arrangement 108, the hydraulic system 132, traction drives 128, etc. to be powered by the battery 116) during an evaluation period prior to the next work session; and the predictive condition value indicates heavy rains are predicted. In this example, it is unlikely that the work vehicle 100 will be operating in the rain. As a result, it is unnecessary to precondition the loader since operation will not occur. In such a scenario, the thermal management precondition module 162 will not activate (or deactivate) the thermal device 136 that may otherwise have been used to precondition the hydraulic arrangement 108 (and/or the implement arrangement 108). Otherwise, if the predictive condition value indicates that the weather is appropriate for operation, the thermal management precondition module 162 will set the operational state of the thermal device 136 to active at a designated time. In particular, the thermal management precondition module 162 will activate the thermal device 136 to warm or otherwise prepare the work component subsystem prior to operation, including while the power source is operating in a power-charging state, thereby mitigating the need to precondition at the work site or immediately prior to operation when then battery 116 is in the power-consuming state. Additionally, if the weather forecast for the subsequent session shows an overnight low temperature below the optimal hydraulic operating threshold, then the system 102 may disables its cooling system at the end of the workday to store heat for the following day. By allowing the hydraulic fluid to retain heat from its operational inefficiencies during the previous day, the work vehicle 100 may be better prepared for potential work on the subsequent day, thereby reducing reliance on battery energy during potential future operations.

In the example depicted in FIG. 2, the thermal management precondition module 162 generates commands associated with the thermal devices of various work components discussed with reference to FIG. 1, including hydraulic system thermal control commands, transmission thermal control commands, power source thermal control commands, cabin HVAC system thermal control commands, and implement system thermal control commands. Additional thermal control commands for additional work component subsystems may be generated by the thermal management precondition module 162.

Figure 3:
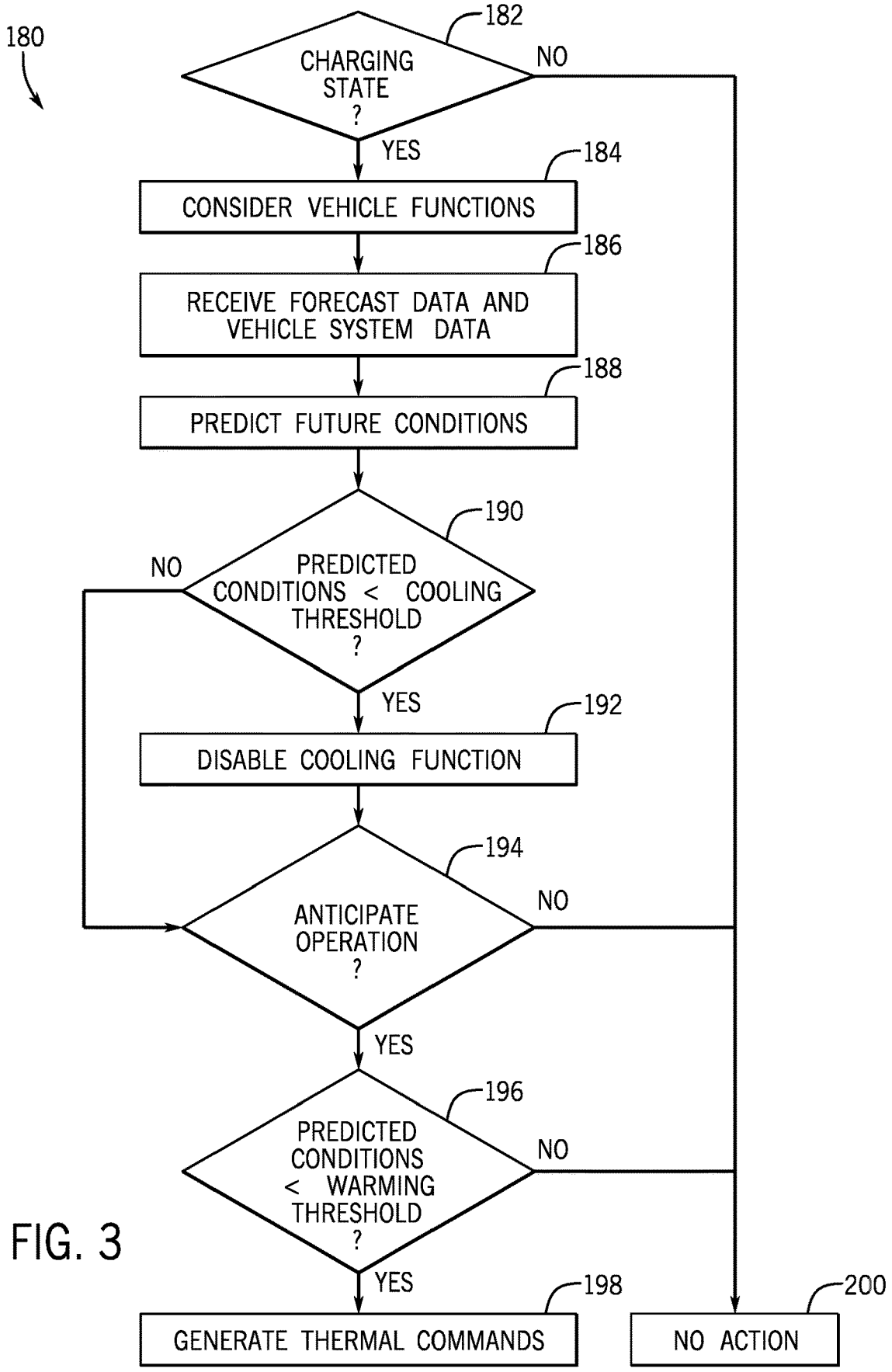
FIG. 3 depicts a flowchart of a method for implementing a work component subsystem preconditioning function according to an example embodiment.

The preconditioning control system discussed herein may further be embodied as a method 180, such as depicted in the flowchart of FIG. 3. The method 180 may implemented by the controller 104 discussed above. In an initial step 182, the system 102 may determine the operating state of the battery 116, particularly to determine if the battery is in the power-charging state. If the battery 116 is in the power-charging state, the method 180 proceeds to step 184. If the battery 116 is not in the power-charging state, the method 180 may proceed to step 200 in which no action is taken. In some examples, step 182 may be optional and the system 102 may operate to precondition the work component subsystem prior to the work time, as described below, regardless of the state of the battery 116 to the same or a lesser extent or with different thresholds (e.g., more conservative) than the system 102 would otherwise precondition the work component subsystem when the battery 116 is in the power-charging state, particularly when the battery 116 is in the lesser power-consuming or idle state. In other words, the method 180 may initiate with step 184. In step 184, the preconditioning control system 102 considers the function of vehicle and/or work component subsystem; and in step 186, the preconditioning control system 102 receives the forecast and/or vehicle system data. In a further step 188, the preconditioning control system 102 predicts future conditions in the form of one or more predictive condition values. In a step 190, the preconditioning control system 102 evaluates to determine if the predicted conditions provide a need to stop any cooling functions. The control model utilizes the weather forecast to predictively store or dissipate heat from operation by enabling or disabling the cooling function for certain systems at the end of the day to achieve optimal system temperatures for efficiency on the following day. Upon completion of step 192 or if, in step 190, the preconditioning control system 102 determines that the cooling function should not be modified, the system determines if the work vehicle 100 will operate the following session. If, in step 194, the work vehicle 100 will not be operating in the next session, the preconditioning control system 102 either takes no action or terminates an existing preconditioning function, as represented in step 200. If, in step 196, the work vehicle 100 will be operating in the next session, the method 180 proceeds to step 196 in which the predicted conditions are compared to the thermal requirements of the relevant work vehicle component subsystem. If the predicted conditions indicate that activation is necessary, the system 102 generates the appropriate thermal commands, as represented by step 196. On the other hand, if the ambient temperature is such that thermal management is not necessary, the preconditioning control system 102 may take no action, as represented by step 198. For example, the preconditioning control system 102 may consider the anticipated ambient temperature relative to the working fluid of the hydraulic arrangement 108 as the work vehicle component subsystem; and if the ambient temperature is such that warming is needed prior to operation, the preconditioning control system 102 generates commands to activate the thermal device 136 of the thermal management system 134 associated with the hydraulic arrangement 108. Generally, upon completion of step 198 or step 200, the preconditioning control system 102 may continue monitoring the forecast data and/or system data such that, if the conditions change such that the modifications to the thermal commands are necessary, the method 180 will repeat.

Accordingly, the preconditioning control system adjusts cooling or heating intensity, activating passive thermal components, or preconditioning the work component subsystem such that the thermal management system ensures optimal performance in different environmental conditions. Preconditioning the work component subsystem during the power-charging state of the electric power source or not in the power-charging state prior to the work time reduces power demands during the power-consuming state. This proactive approach conserves energy and enhances the overall performance and longevity of the work component subsystem. As a result, the electric work vehicle benefits from increased efficiency, reduced power consumption, cost savings, and better utilization of available resources.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

As will be appreciated by one skilled in the art, certain aspects of the disclosed subject matter can be embodied as a method, system (e.g., a work machine control system included in a work machine), or computer program product. Accordingly, certain embodiments can be implemented entirely as hardware, entirely as software (including firmware, resident software, micro-code, etc.) or as a combination of software and hardware (and other) aspects. Furthermore, certain embodiments can take the form of a computer program product on a computer-usable storage medium having computer-usable program code embodied in the medium.

As used herein, the term module refers to any hardware, software, firmware, electronic control component, processing logic, and/or processor device, individually or in any combination, including without limitation: application specific integrated circuit (ASIC), an electronic circuit, a processor (shared, dedicated, or group) and memory that executes one or more software or firmware programs, a combinational logic circuit, and/or other suitable components that provide the described functionality. The term module may be synonymous with unit, component, subsystem, sub-controller, circuitry, routine, element, structure, control section, and the like.

Embodiments of the present disclosure may be described herein in terms of functional and/or logical block components and various processing steps. It should be appreciated that such block components may be realized by any number of hardware, software, and/or firmware components configured to perform the specified functions. For example, an embodiment of the present disclosure may employ various integrated circuit components, e.g., memory elements, digital signal processing elements, logic elements, look-up tables, or the like, which may carry out a variety of functions under the control of one or more microprocessors or other control devices. In addition, those skilled in the art will appreciate that embodiments of the present disclosure may be practiced in conjunction with any number of work vehicles.

For the sake of brevity, conventional techniques related to signal processing, data transmission, signaling, control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in an embodiment of the present disclosure.

The description of the present disclosure has been presented for purposes of illustration and description, but it is not intended to be exhaustive or limited to the disclosure in the form disclosed. Many modifications and variations will be apparent to those of ordinary skill in the art without departing from the scope and spirit of the disclosure. Explicitly referenced embodiments herein were chosen and described in order to best explain the principles of the disclosure and their practical application, and to enable others of ordinary skill in the art to understand the disclosure and recognize many alternatives, modifications, and variations on the described example(s). Accordingly, various embodiments and implementations other than those explicitly described are within the scope of the following claims.

What is claimed is:

1. An electric work vehicle comprising:

an electric power source operable in a power-charging state and a power-consuming state;

an electric motor powered by the electric power source;

a work component powered by the electric power source during the power-consuming state to perform a work operation at a work location at a work time;

a work component subsystem operating the work component and powered by the electric power source, the work component subsystem optimally operable within a temperature range;

a thermal management system including a thermal device for affecting the temperature range of the work component subsystem;

a controller, including processor and memory architecture, executing control logic to:

receive a predictive condition value indicative of an environmental condition of the work location at the work time, the predictive condition value being received by the controller at an evaluation time preceding the work time;

based on the predictive condition value, set an operational state of the thermal device of the thermal management system; and operate the thermal device at the operational state set according to the predictive condition value to precondition the work component subsystem prior to the work time to reduce power demands on the electric power source during the power-consuming state.

2. The electric work vehicle of claim 1, wherein the controller is configured to operate the thermal device to precondition the work component subsystem during the power-charging state of the electric power source.

3. The electric work vehicle of claim 2, wherein the predictive condition value is extracted from a weather forecast feed received by the controller;

wherein the weather forecast includes an anticipated precipitation value as the predictive condition value received by the controller; and wherein the controller compares the anticipated precipitation value to a threshold precipitation value to determine whether to precondition the work component subsystem.

4. The electric work vehicle of claim 2, wherein the predictive condition value is extracted from a weather forecast feed received by the controller;

wherein the weather forecast includes an ambient temperature value as the predictive condition value received by the controller; and wherein the controller processes the ambient temperature value to set the operational state of the thermal device and determine a period of time to operate the thermal device and precondition the work component subsystem during the power-charging state of the electric power source.

5. The electric work vehicle of claim 1, wherein the work component subsystem includes a working fluid utilized by the work component subsystem to operate the work component; and wherein the temperature range applies to the working fluid.

6. The electric work vehicle of claim 5, wherein the work component is a traction drive including a gear reduction assembly that provides rotational torque to ground-engaging wheels or tracks of the electric work vehicle.

7. The electric work vehicle of claim 5, wherein the work component is a work implement including an implement actuator, the work component subsystem being operable to effect movement of the work implement by the implement actuator.

8. The electric work vehicle of claim 7, wherein the work component subsystem includes a pump for pressurizing the working fluid; and wherein the implement actuator includes a piston-cylinder driven by the pressurized working fluid of the work component subsystem.

9. The electric work vehicle of claim 1, wherein the thermal device includes a heating device, a cooling device, or both;

wherein the thermal device includes an off state in which the thermal device is idle or provides a passive thermal effect on the temperature range of the work component subsystem; and wherein the thermal device includes an on state in which the thermal device is energized to provide an active thermal effect on the temperature range of the work component subsystem.

10. The electric work vehicle of claim 9, wherein the controller is configured to execute the control logic to receive a state input for the thermal device indicating whether the thermal device is in the off state or the on state, and to change the state of the thermal device from the off state to the on state when the predictive condition value indicates to precondition the work component subsystem only during the power-charging state of the electric power source.

11. The electric work vehicle of claim 10, wherein the controller is configured to execute the control logic to receive a charge state input for the electric power source indicating whether the electric power source is in the power-charging state or the power-consuming state, and to operate the thermal device at the operational state set according to the predictive condition value to precondition the work component subsystem only during the power-charging state of the electric power source.

12. The electric work vehicle of claim 11, wherein the controller is configured to operate the thermal device to precondition the work component subsystem during the power-charging state of the electric power source.

13. The electric work vehicle of claim 12, wherein the predictive condition value is extracted from a weather forecast feed received by the controller;

wherein the weather forecast includes an anticipated precipitation value as the predictive condition value received by the controller; and wherein the controller compares the anticipated precipitation value to a threshold precipitation value to determine whether to precondition the work component subsystem.

14. The electric work vehicle of claim 12, wherein the predictive condition value is extracted from a weather forecast feed received by the controller;

wherein the weather forecast includes an ambient temperature value as the predictive condition value received by the controller; and wherein the controller processes the ambient temperature value to set the operational state of the thermal device and determine a period of time to operate the thermal device and precondition the work component subsystem during the power-charging state of the electric power source.

15. An electric work vehicle comprising:

an electric power source operable in a power-charging state and a power-consuming state;

an electric motor powered by the electric power source;

a work component powered by the electric power source during the power-consuming state to perform a work operation at a work location at a work time;

a work component subsystem operating the work component and powered by the electric power source, the work component subsystem includes a working fluid to operate the work component and that is optimally operable within a temperature range;

a thermal management system including a thermal device for affecting the temperature range of the work component subsystem;

a controller, including processor and memory architecture, executing control logic to:

receive a predictive condition value indicative of an environmental condition of the work location at the work time, the predictive condition value being received by the controller at an evaluation time preceding the work time;

based on the predictive condition value, set an operational state of the thermal device of the thermal management system; and operate the thermal device at the operational state set according to the predictive condition value to precondition the work component subsystem prior to the work time to reduce power demands on the electric power source during the power-consuming state.

16. The electric work vehicle of claim 15, wherein the work component is a traction drive including a gear reduction assembly that provides rotational torque to ground-engaging wheels or tracks of the electric work vehicle.

17. The electric work vehicle of claim 15, wherein the work component is a work implement including an implement actuator, the work component subsystem being operable to effect movement of the work implement by the implement actuator;

wherein the work component subsystem includes a pump for pressurizing the working fluid; and wherein the implement actuator includes a piston-cylinder driven by the pressurized working fluid of the work component subsystem.

18. The electric work vehicle of claim 15, wherein the thermal device includes a heating device, a cooling device, or both;

wherein the thermal device includes an off state in which the thermal device is idle or provides a passive thermal effect on the temperature range of the work component subsystem; and wherein the thermal device includes an on state in which the thermal device is energized to provide an active thermal effect on the temperature range of the work component subsystem.

19. The electric work vehicle of claim 18, wherein the controller is configured to execute the control logic to receive a state input for the thermal device indicating whether the thermal device is in the off state or the on state, and to change the state of the thermal device from the off state to the on state when the predictive condition value indicates to precondition the work component subsystem only during the power-charging state of the electric power source.

20. The electric work vehicle of claim 19, wherein the controller is configured to execute the control logic to receive a charge state input for the electric power source indicating whether the electric power source is in the power-charging state or the power-consuming state, and to operate the thermal device at the operational state set according to the predictive condition value to precondition the work component subsystem only during the power-charging state of the electric power source.

* * * * *